US010641283B2

(12) United States Patent
Wendland

(10) Patent No.: US 10,641,283 B2
(45) Date of Patent: May 5, 2020

(54) CENTRIFUGAL PUMP

(71) Applicant: Donald Wendland, Saginaw, MI (US)

(72) Inventor: Donald Wendland, Saginaw, MI (US)

( * ) Notice: Subject to any disclaimer, the term of this patent is extended or adjusted under 35 U.S.C. 154(b) by 103 days.

(21) Appl. No.: 15/959,577

(22) Filed: Apr. 23, 2018

(65) Prior Publication Data

US 2019/0323517 A1 Oct. 24, 2019

(51) Int. Cl.

| | |
|---|---|
| ***F04D 29/42*** | (2006.01) |
| ***F04D 13/06*** | (2006.01) |
| ***F04D 13/14*** | (2006.01) |
| ***F04D 29/043*** | (2006.01) |
| ***F04D 13/08*** | (2006.01) |
| *F04D 29/22* | (2006.01) |

(52) U.S. Cl.

CPC ..... *F04D 29/426* (2013.01); *F04D 13/06* (2013.01); *F04D 13/08* (2013.01); *F04D 13/14* (2013.01); *F04D 29/043* (2013.01); *F04D 29/2216* (2013.01)

(58) Field of Classification Search

CPC .... F04D 13/08; F04D 29/043; F04D 29/2216; F04D 29/2222; F04D 29/4213; F04D 29/426; F04D 29/708

See application file for complete search history.

(56) References Cited

U.S. PATENT DOCUMENTS

| | | | | |
|---|---|---|---|---|
| 3,519,365 | A * | 7/1970 | Conhagen | F04D 29/2277 415/88 |
| 4,013,383 | A * | 3/1977 | Rule | F04D 9/001 417/366 |
| 4,281,962 | A | 8/1981 | Erickson | |
| 4,815,929 | A | 3/1989 | Weinrib | |
| 5,114,312 | A | 5/1992 | Stanislao | |
| 7,686,573 | B2 | 3/2010 | Clement | |
| 8,501,084 | B2 * | 8/2013 | Cooper | F04D 7/065 266/233 |
| 10,138,891 | B2 * | 11/2018 | Pemberton | F04D 7/04 |
| 2017/0248113 | A1 * | 8/2017 | Santana | F03B 17/063 |

* cited by examiner

*Primary Examiner* — Dominick L Plakkoottam

(57) ABSTRACT

A centrifugal pump that is used for conveying water and other fluids. The pump is constructed such that the movement of water is provided without undue pressures being needed.

10 Claims, 5 Drawing Sheets

CENTRIFUGAL PUMP

BACKGROUND OF THE INVENTION

The device of the instant invention is a centrifugal pump that is used for conveying water and other fluids. The pump is constructed such that the movement of water is provided without undue pressures being needed.

A high pressure centrifugal pump is disclosed in Erickson, U.S. Pat. No. 4,281,962 that issued Aug. 4, 1981, consisting of an independent rotor assembly and an independent drive shaft, rotating in opposite directions, in order to create the high fluid pressure generated at the fluid outlet.

U.S. Pat. No. 4,815,929 that issued to Weinrib on Mar. 28, 1989 is directed to an eddy pump. The pump has the capacity to generate a vortex and ambient liquids are drawn through the pump inlet in a counter-flow to the vortex column flow and then flows into the pump casing and then out through a pump discharge.

There is disclosed in U.S. Pat. No. 5,114,312, issued to Stanislao on May 19, 1992, a slurry pump that has a unique prime situation. An output passage from a fluid housing links the fluid chamber to an exterior of the pump to permit fluid to exit the pump. A feedback input passage links the output passage back to the fluid chamber to permit a portion of the fluid exiting the pump to reenter a fluid chamber, thus creating a dynamic and continual prime situation.

U.S. Pat. No. 7,686,573, that issued Mar. 30, 2010 to Clement deals with a vertically-oriented centrifugal pump that contains a ramped surface to enable the easy passage of fluid through the pump.

None of the prior art references disclose the device of the instant invention and its major benefits.

THE INVENTION

Thus, what is disclosed and claimed herein is a centrifugal pump. The pump comprises a square housing, wherein the housing has a top end and a bottom end. The top end and the bottom end have internal cross bracing bars. The cross bracing bars have a centered opening through them.

The top end has a circumferential flattened rim, the rim having a plurality of openings through it. The bottom end has a circumferential flattened rim having a plurality of openings through it. The bottom is covered by a flat plate which is secured to the bottom. The flat plate has a centered opening and four corners. Each corner has attached to an outside surface, a leg.

Each side of the square housing, near the bottom end, has an opening through it. There is a centered drive shaft, the centered drive shaft having a length extending from beneath the bottom plate to above the top end. The drive shaft is enclosed in a second housing, which is surmounted on the cross bars at the bottom end and extends to, and attaches, to the top end cross bars.

There is mounted near the lower end of the drive shaft, a set of two impellers, one impeller facing the bottom plate, the second impeller facing in the opposite direction, the blades being positioned back to back on the drive shaft. There is mounted on the top end of the housing, an exit housing, containing at least one opening through it.

In a further embodiment, there is a pump as defined Supra, in which The centrifugal pump has, in addition, diverter panels mounted on the interior of the housing, at the bottom thereof, in each corner of the housing thereof.

DETAILED DESCRIPTION OF THE INVENTION

Figure 1:
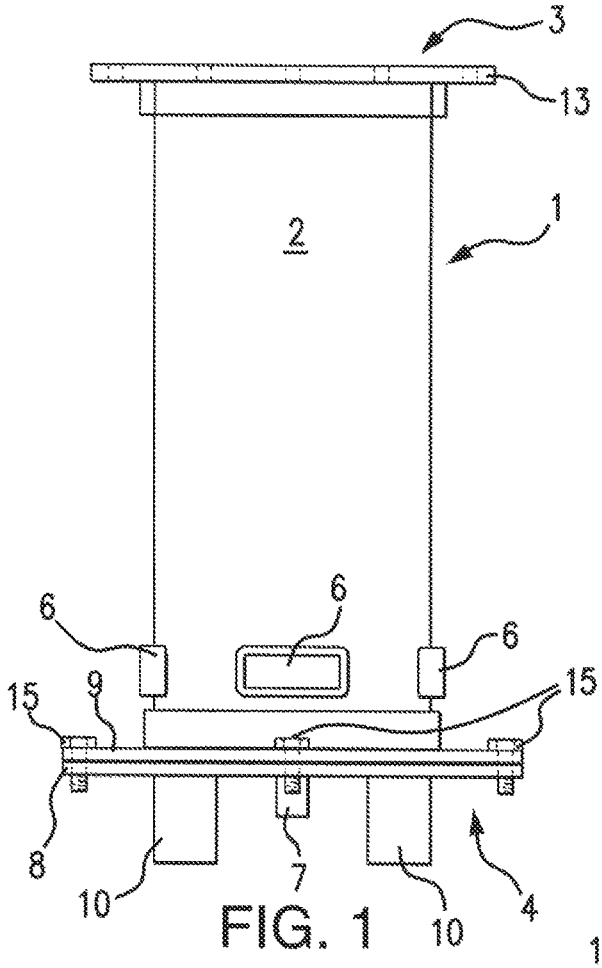
FIG. 1 is full front view of a pump of this invention.

Turning now to the description of the invention, there is shown in FIG. 1 a full front view of a centrifugal pump 1 of this invention which is primarily designed to be partially submerged in a flooded terrain to move water from, say, for example, a farmer's field to drainage ditches. Shown is the housing 2, the top end 3, the bottom end 4, side water ports 6, the bottom end of a drive shaft 7, the flat plate 8 at the bottom end 4, the bottom circumferential rim 9, legs 10, and the top circumferential plate 13.

The bottom plate 8 rests on four corner legs 10. The legs 10 are long enough that the cutting blades 11 and 12 (FIGS. 7A, 7B, and 8) are suspended above any hard surface that the pump 1 rests on. Another purpose of the legs 10 is to raise the pump 1 up from any hard surface far enough to allow water to flow underneath the pump and enter the opening 14 in the bottom plate 8 unrestricted.

The bottom flat plate 8 is secured to the bottom of the pump housing 2 by bolts 15, or any other convenient means that will allow the removal of the bottom flat plate 8 for repair or otherwise.

Figure 2:
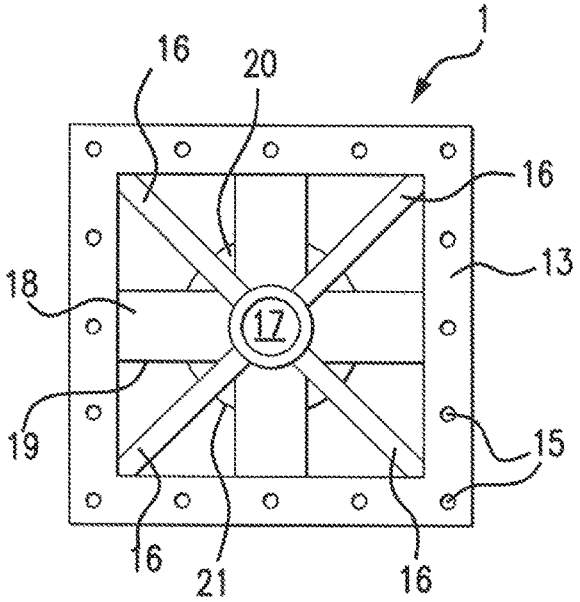
FIG. 2 is a full top view of the pump of FIG. 1.
Figure 11:
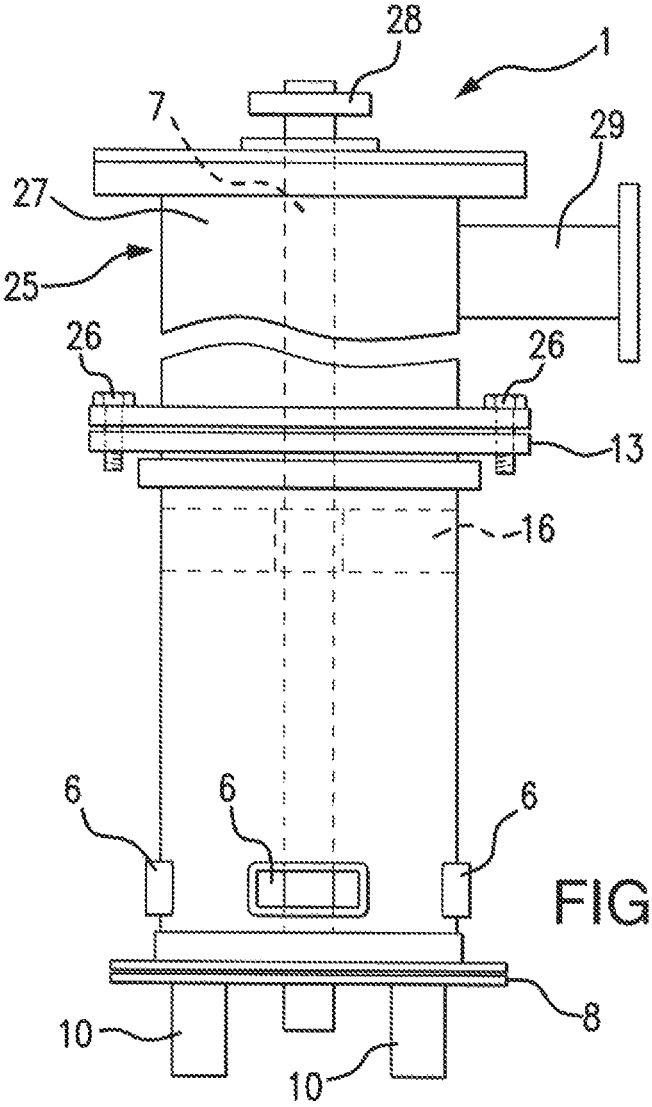
FIG. 11 is a full side view of a pump of FIG. 1 with an exit hood and port mounted on the top.

With regard to FIG. 2, which is a full top view of the pump 1 of this invention with the exit port removed wherein there is shown the inside of the housing 2 and in addition, there is shown the circumferential top plate 13, with bolt openings 15, the top cross bars 16, and in the center, where the bars normally cross, is an opening 17 for a drive shaft 7 (FIG. 11). Also shown is the top 18 of the bottom cross bars 19 and the top 20 of the top impeller 21.

Figure 4:
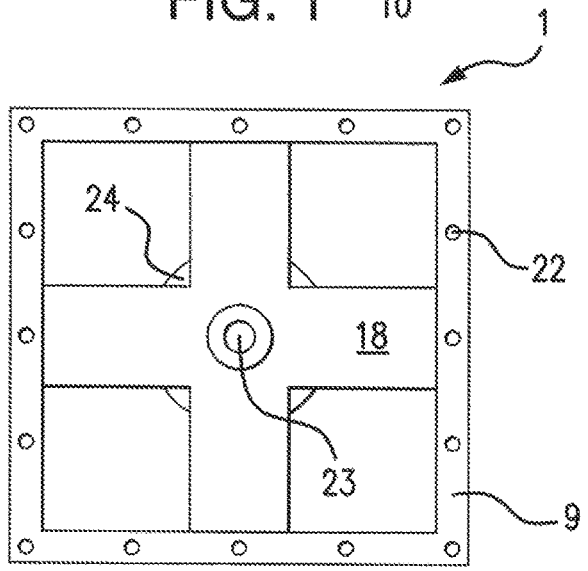
FIG. 4 is a top view of the lower cross bars and shaft opening along with a partial view of an impeller.
Figure 3:
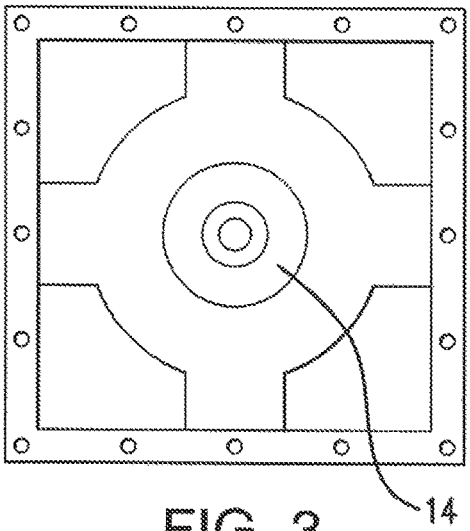
FIG. 3 is a full bottom view of the pump of FIG. 1.

Turning now to FIG. 4, there is shown a full bottom view without the bottom flat plate 8 of the pump 1 wherein there is shown the circumferential rim 9, the bolt holes 22, the center opening 23, the bottom surface of the bottom cross bars 18 and a portion of the bottom impeller 24.

Figure 5:
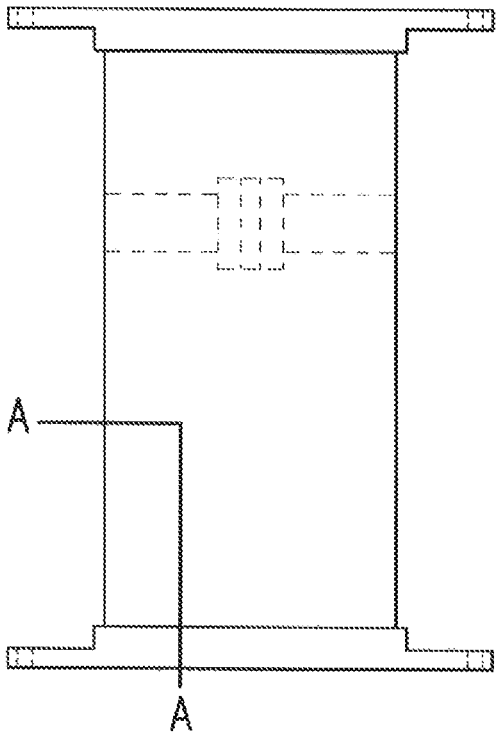
FIG. 5 is an extension segment for the pump of FIG. 1.

Turning now to FIG. 5, there is shown an extension housing 27 with a top circumferential rim 30, a bottom circumferential rim 31, top cross bars 32 (in phantom), with a shaft support collar 33 (in phantom). These segments can be on average, 1 foot in length to 5 or 6 feet in length, depending on how much water is in a particular environment. The plates have openings that match the openings in the top and bottom circumferential rims of the pump housing.

Figure 6:
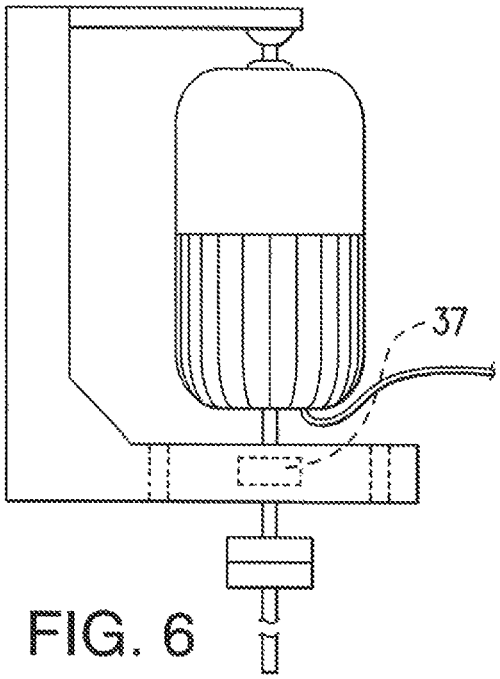
FIG. 6 is a full side view of a motor and motor stand for use on the pump of FIG. 1.

FIG. 6 shows an electric motor that can provide power to the drive shaft 7. It is mounted on a support stand 35 that can be mounted on the exit port 25. It is contemplated within the scope of this invention to provide any convenient source of power for the drive shaft 7, including electric motors, fuel powered motors and the like, it should be understood, however, that the inventive device is a direct drive mechanism and does not depend on belts or chains.

Figure 9:
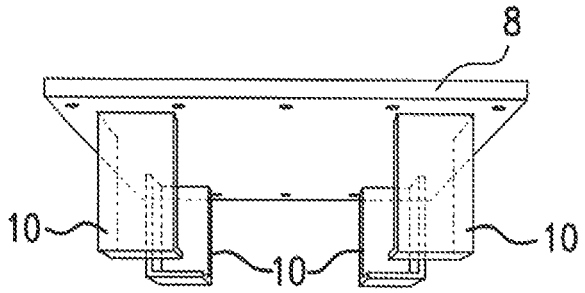
FIG. 9 is a full side view of a bottom plate of this invention wherein the top of the drawing is tilted slightly backward.

FIG. 9 is a side view of the flat bottom plate 8 with the legs 10 extending therefrom. The view has a tilted top end backwards so that the legs 10 can be shown in perspective.

Figure 10:
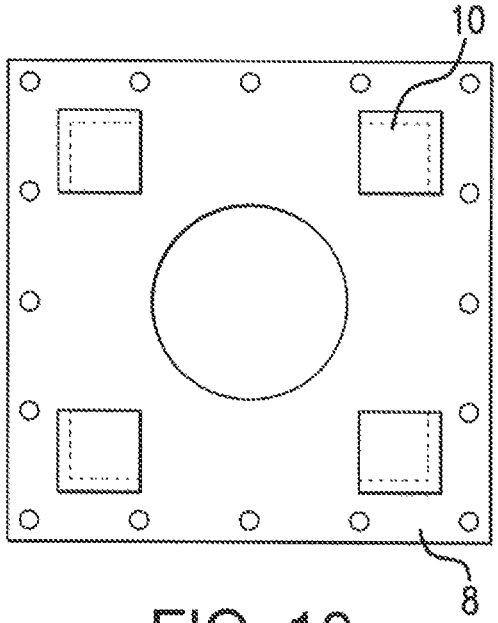
FIG. 10 is a full bottom view of the plate of FIG. 9.

FIG. 10 is a full bottom view of the bottom flat plate 8 showing the legs 10, the centered opening 14, and the bolt holes 22.

FIG. 11 is a full front view of a pump 1 of this invention with an exit port 25 surmounted on the top circumferential rim 13, in this illustration, using bolts 26. The pump 1 is designed to enable extensions of the housing with support cross bars to be mounted on top of the pump and then the mounting of the exit port 25 on top of the extension housing 27. It is contemplated within scope of this invention to use as many extension segments as is needed to provide for the exit port 29 to be above the top level of any water. There is shown the extension housing 27, the drive shaft 7 (in phantom), a top gear 28 for the drive shaft, the side exit port 29, the legs 10, the side ports 6, the top cross bars 16, and the bottom flat plate 8.

Figure 7B:
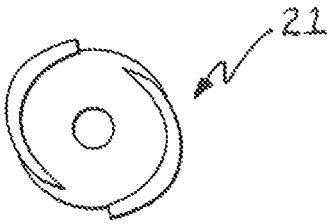
FIG. 7B is a top view of the upper impeller of this invention.
Figure 7A:
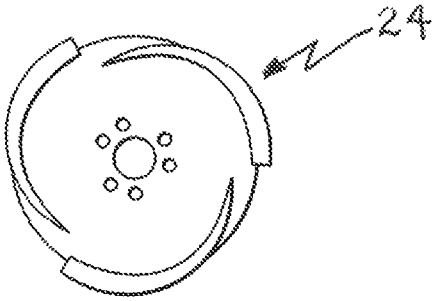
FIG. 7A is a bottom view of the lower impeller of this invention.
Figure 8:
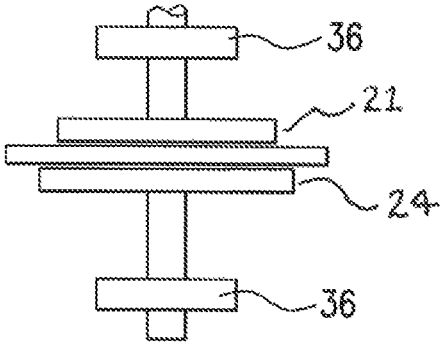
FIG. 8 is a side view of the impellers mounted back to back.
Figure 12:
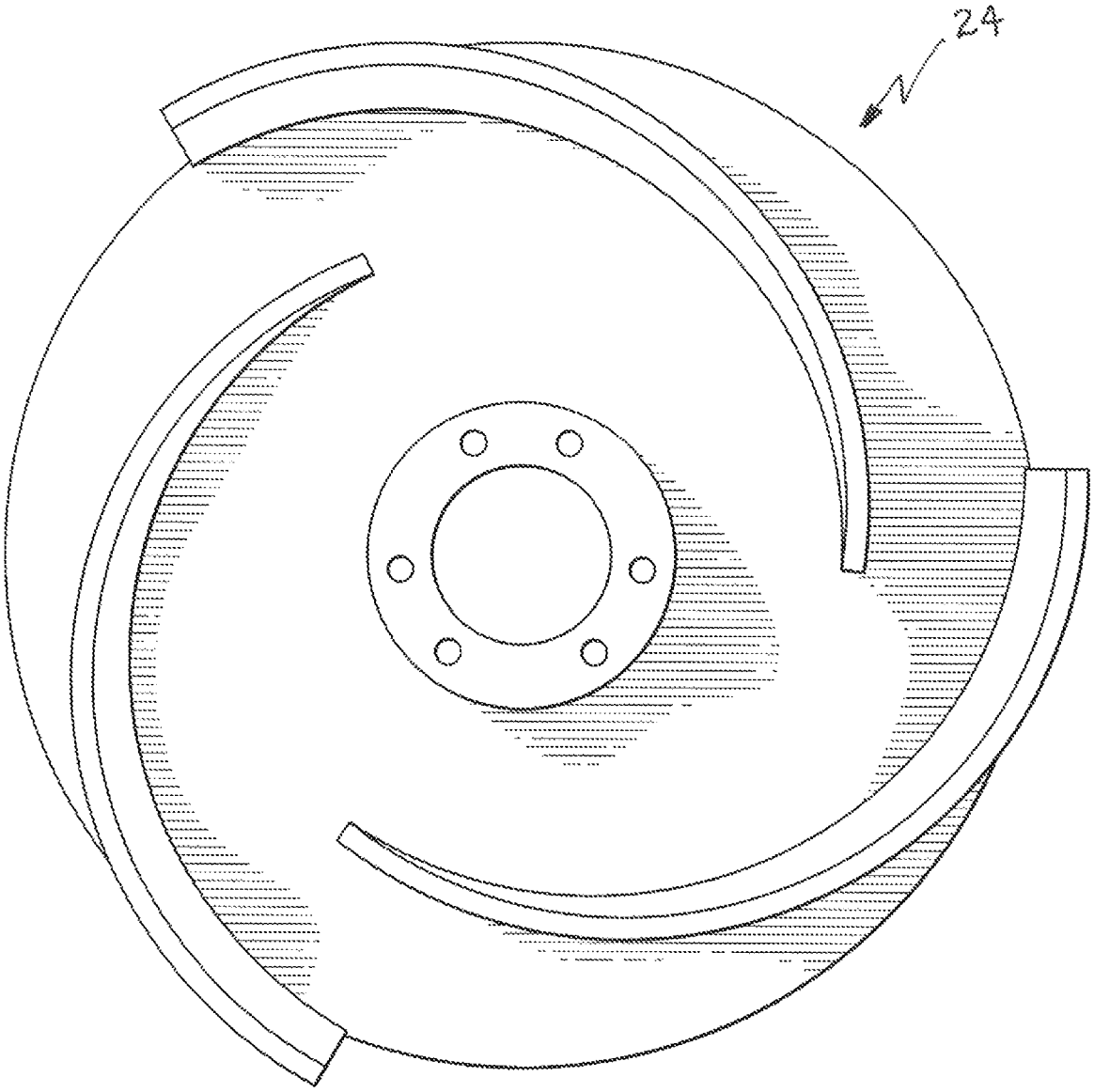
FIG. 12 is an enlarged bottom view of the bottom impeller of this invention.

FIG. 12 is a full bottom view of the bottom impeller (impeller) 24 and FIGS. 7A and 7B compare two impellers in relative size. FIG. 8 shows the blades mounted on the shaft with a small spacer plate in between them. Note from FIG. 8 that the shaft is equipped with bearings 36. The shaft is also equipped with a bearing 37 at the top of the shaft. The fins on the impeller have to be balanced with the same weight and same shape in order for the pump to perform efficiently. It is contemplated within the scope of this invention to use at least two or more fins on the impellers.

Typically, the preferred number is three such fins. Shown in FIG. 8 is a stack of two impellers, but it is contemplated within the scope of this invention to have more than two such impellers. The inventor herein has used impeller stacks of 5 such impellers.

Thus, in use, the pump 1 is constructed with the bottom flat plate 8 and secured in place after the drive shaft 7 is inserted in the centered openings in the braces. The necessary extensions are then bolted in place if needed. Then, the exit port 25 is mounted and any needed piping to carry the water away from the pump is put in place.

It is critical to provide the amount of open area of the opening in the bottom flat plate and the open area of the openings in the side housing walls, and the size of the impellers with regard to each other, for example, the combined area of the water intakes should be larger than the circle opening 24 in the bottom flat plate 8. The combined area of the four corners of the housing is smaller than the exit. By this means, one can decrease the resistance to movement of water. Thus, it can be observed that the amount of open area provided by the corners that is provided by the bottom flat plate and the walls of the housing is critical as well.

The pump housing is nominally 10 to 24 inches square and the large opening in the bottom flat plate has to have an open area of 6½ to 14 inches in circumference. The rush of water through the bottom opening, along with the input of water from the side wall openings fills the entire bottom of the pump surrounding the impellers. Because of this area, there is little or no back pressure on the water inside the pump housing. Likewise, the exit port at the top has to have a certain amount of open area for the discharge of the water.

Figure 13:
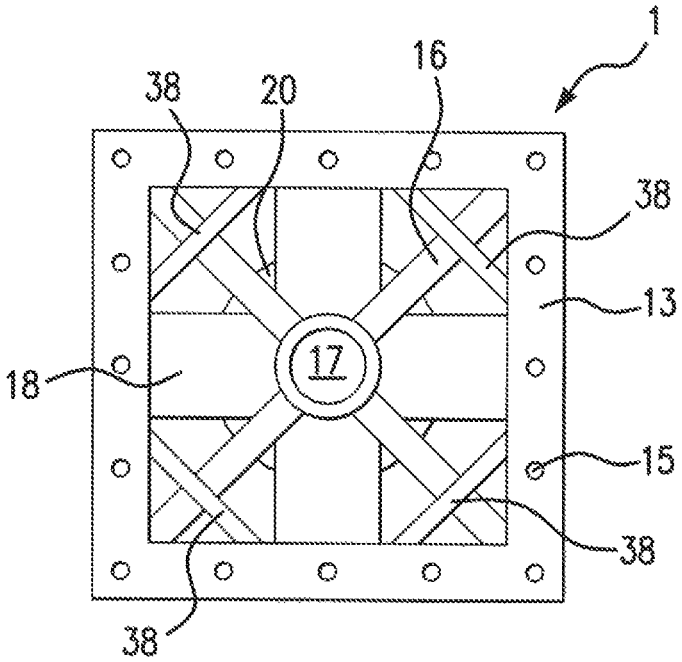
FIG. 13 is a bottom view of the pump without the bottom panel in place.

In another embodiment, the pump as described Supra has triangular diverter panels 38 (FIG. 13) mounted in each corner of the housing, at the bottom, so that the efficiency of the pump can be enhanced. These triangular diverter panels 38 cause the water to be vertically diverted upwards from the impeller. The pointed top of the triangular diverter panel 38 is secured into each actual corner of the housing several inches from the bottom of the housing, while the bottom of the triangular diverter panel 38 is located 2 or 3 inches from the actual corner of the housing. Thus, each diverter panel 38 is tiled from the vertical by several degrees from the vertical.

Figure 14:
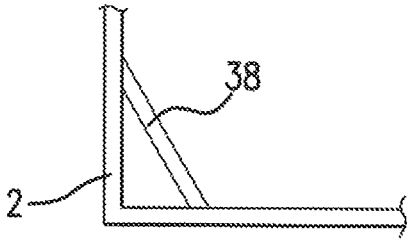
FIG. 14 is a partial section of the housing with a triangular diverter panel mounted in the corner.
Figure 15:
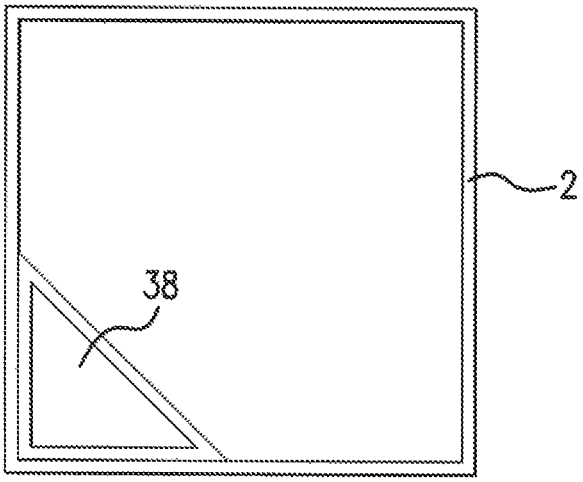
FIG. 15 is view of a housing from the top showing a triangular diverter panel in place in the bottom of the housing.

FIG. 14 shows a partial section of the bottom of the housing 2 through line A-A of FIG. 5, which FIG. 15 shows a view of one triangular diverter panel 38 from the top of the housing, with all of the bracing and other components left out for clarity.

By this means, the water enters the bottom opening, the side port openings and is immediately picked up by the impellers and lifted to the top of the pump housing where it exits. It should be additionally noted that the configurations of the housing other than square are inefficient.

The pumps can be constructed from steel, and in some cases, stainless steel is preferred.

What is claimed is:

1. A centrifugal pump, said pump comprising:

A. a square housing, said square housing having a top end and a bottom end, said top end and said bottom end having internal cross bracing bars, said bars having a centered opening therethrough; said top end having a circumferential flattened rim, said rim having a plurality of openings therethrough;

B. said bottom end having a circumferential flattened rim having a plurality of openings therethrough, said bottom end being covered by a flat plate secured thereto, said flat plate having a centered opening; said flat plate having four corners, each corner having attached to an outside surface, a leg;

C. each side of said square housing, near said bottom end, having an opening therethrough;

D. a centered drive shaft, said centered drive shaft having a length extending from beneath said bottom end to above said top end, said drive shaft enclosed in a housing, which is surmounted on said cross bars at the bottom end and extends to, and attaches, to said top end cross bars;

E. there being mounted near a lower end of said drive shaft, a set of two impellers, one said impeller facing said bottom plate, the second said impeller facing in the opposite direction, said impellers being positioned back to back on said drive shaft;

F. there being mounted on said top end of said square housing an exit housing containing at least one opening therethrough.

2. The centrifugal pump as claimed in claim 1 wherein the pump is manufactured from metal.

3. The centrifugal pump as claimed in claim 2 wherein the metal is steel.

4. The centrifugal pump as claimed in claim 2 wherein the metal is stainless steel.

5. The centrifugal pump as claimed in claim 1, wherein, said shaft is mounted at said top end by a drive means.

6. The centrifugal pump as claimed in claim 5, wherein, said drive means is a motor.

7. The centrifugal pump as claimed in claim 6, wherein, the motor is an electric motor.

8. The centrifugal pump as claimed in claim 6, wherein, the motor is a gasoline motor and the shaft is turned by belts and pulleys.

9. The centrifugal pump as claimed in claim 1 wherein the housing, cross bars, and circumferential flattened rims are all welded together.

10. The centrifugal pump as claimed in claim 1 wherein, in addition, there are triangular diverter panels mounted on the interior of the square housing, at the bottom thereof, in each corner of said square housing thereof.

* * * * *